United States Patent [19]

Snellman et al.

[11] Patent Number: 4,879,002

[45] Date of Patent: Nov. 7, 1989

[54] FRAME CONSTRUCTION OF THE PRESS SECTION IN A PAPER MACHINE

[75] Inventors: Yrjö Snellman, Tampere; Mauri Rantala, Nokia, both of Finland

[73] Assignee: Oy Tampella Ab, Tampere, Finland

[21] Appl. No.: 244,883

[22] Filed: Sep. 15, 1988

[30] Foreign Application Priority Data

Sep. 15, 1987 [FI] Finland ..... 874003

[51] Int. Cl.[4] ..... D21F 3/00

[52] U.S. Cl. ..... 162/273; 162/272; 162/358; 162/360.1

[58] Field of Search ..... 162/305, 358, 360.1, 162/272–274

[56] References Cited

U.S. PATENT DOCUMENTS

| | | | |
|---|---|---|---|
| 1,851,941 | 3/1932 | Broadhurst | 162/273 |
| 4,450,630 | 5/1984 | Phelps | 162/273 |
| 4,608,125 | 8/1986 | Autio | 162/272 |

FOREIGN PATENT DOCUMENTS 70951 7/1986 Finland .

OTHER PUBLICATIONS

Article: "Industria della Carta" Nov. 1984, vol. 22, No. 11.

*Primary Examiner*—Karen Hastings

*Attorney, Agent, or Firm*—Pollock, Vande Sande & Priddy

[57] ABSTRACT

The frame construction in the press section of a paper machine in which the press section includes a combination of rolls which form at least one nip, members for guiding the paper web through the press section and members for guiding at least one felt into contact with the press section. The frame construction comprises a front frame, a rear frame and an intermediate frame connecting these two from above the press section. The connections of the intermediate frame both to the front frame and to the rear frame are releasable in order to remove the intermediate frame in a substantially horizontal and longitudinal direction from above the roll combination into a supporting member.

4 Claims, 1 Drawing Sheet

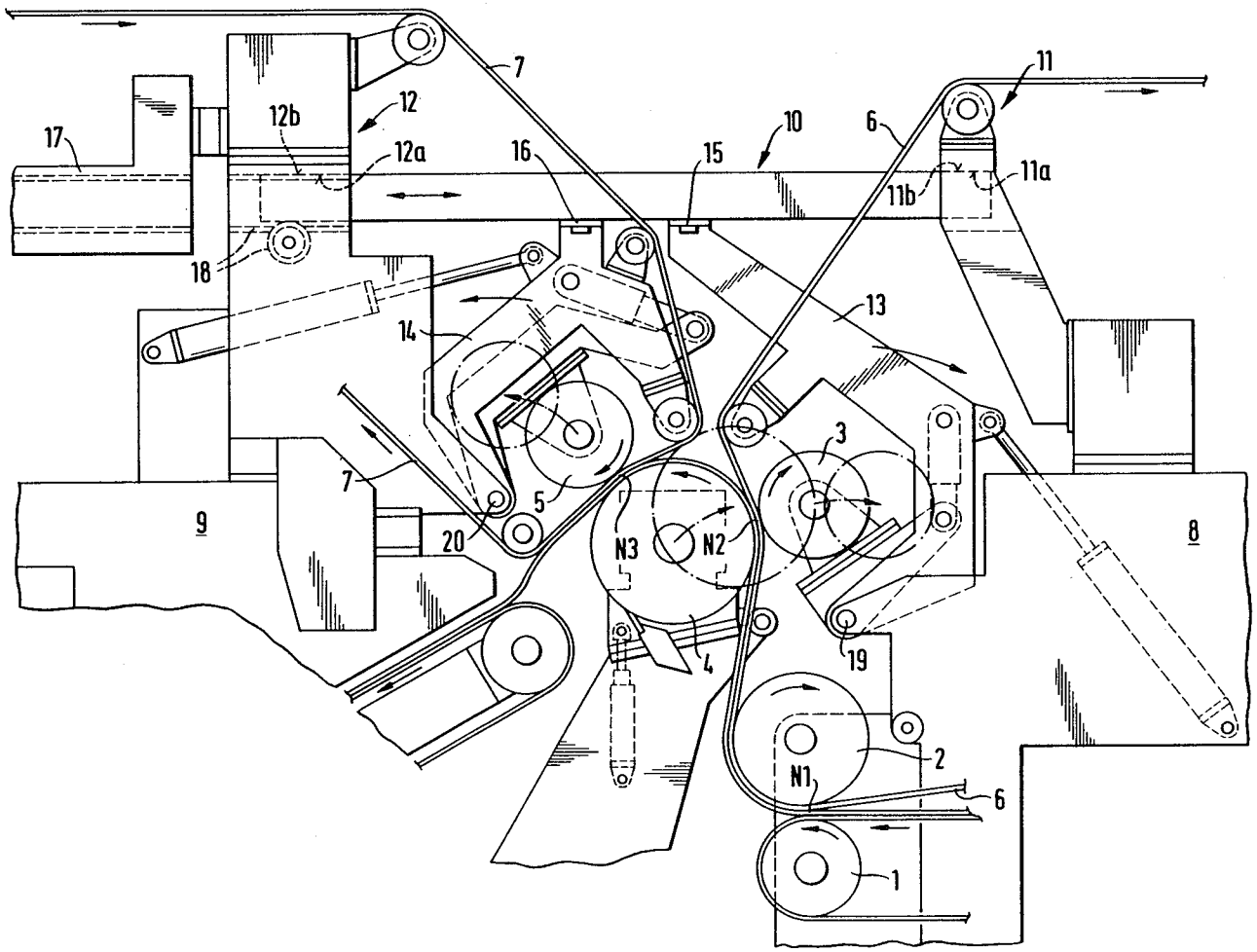
11
11a
11b
6
10
15
16
7
12
12a
12b
17
18
13
14
8
9
3
5
20
7
N3
N2
4
19
N1
2
1
6

FRAME CONSTRUCTION OF THE PRESS SECTION IN A PAPER MACHINE

FIELD OF THE INVENTION

The present invention relates to the frame construction of the press in a paper machine, the press section comprising a combination of rolls, the rolls of which form at least one nip, members for guiding the paper web through the press section and members for guiding at least one felt or the equivalent into contact with the press section, the frame construction comprising a front frame, a rear frame and an intermediate frame connecting these two from above the press section.

BACKGROUND ART

Constructions of this type are used to some extent nowadays.

Beloit Corporation has proposed so-called "FLIP-TOP" frame construction. In this construction, a two-piece intermediate frame is disposed above the press section of the paper machine to connect the front and rear frames of the press section. During the operation of the press section, the ends of the intermediate frame are fixed both to the front and the rear frame. Either of these attachments can be detached and the detached portion of the intermediate frame can be pivoted into the center of the intermediate frame, around the transverse articulated shaft of the paper machine. The partial opening of the intermediate frame has the purpose of facilitating the felt exchange on the press section. The "FLIP-TOP"-frame construction does not essentially improve other functions relating in particular to the service or operability of the press section.

Valmet Oy has proposed several frame constructions of the press section. The so-called SYM-PRESS press section is known, in which horizontal beams providing a solid connection of the front and rear frames of the press section are disposed above the press rolls in a compact press section, both on the service and the driving side of the paper machine. This kind of solution is difficult in particular with regard to the services of the press section, since, being stationary above the press section, the beams hamper and delay the service operations. The further development of this frame construction has resulted in the frame structures described in the Finnish patent applications 844693 and 854959 of Valmet Oy. These publications disclose intermediate frame constructions, in which a one-piece intermediate frame is pivotally articulated to the rear frame of the press section and disposed to be detachably fixed to the front frame (FI-844693), or alternatively, the intermediate frame consists of two pieces, the pieces being articulated into the front frame on the one hand and into the rear frame on the other hand (FI-854959). The free ends of the pieces of the intermediate frame are disposed to be fixed to the fixed intermediate part of the intermediate frame (FI-854959). The intermediate frames described above are pivotable around their articulating points in the vertical plane partly away from above the roll arrangement of the press section especially for service operations. It is difficult to make this type of constructions sufficiently solid and thus resistent to vibration.

The constructor of the press section of a modern paper machine has to fulfill two opposite requirements. On the one hand, the frame construction of the press section, the front frame, the rear frame and the intermediate frame connecting these two, should form a sufficiently rigid construction, which, during the operation of the press section, ensures a trouble-free operation of the press section. However, on the other hand, the compact press section, the machine elements of which, such as press rolls, press fabrics and members for guiding the web, are very close to each other in the operating position, should, in view of the necessary repeated services of the paper machine, have a construction that allows to perform efficiently the service operations. This means that the press section should be opened to a necessary extent relatively easily and the above machine elements should be easily accessible in such opened position.

SUMMARY OF THE INVENTION

The object of the present invention is to provide a press section that fulfills the requirements described above. The press section according to the invention is rigid in the operating position and on the other hand it allows the machine elements in the press section to be easily and rapidly serviced.

In order to achieve this purpose, in the press section according to the invention the connections of the intermediate frame, both to the front frame and to the rear frame, are releasable in order to remove the intermediate frame from above the press section and the removal is carried out essentially horizontally. In this case, the front and rear frames of the press section are firmly connected to each other by the intermediate frame in the direction of the machine during operation. Thus, a rigid frame assembly is formed. During service operations, the intermediate frame is detachable and horizontally displaceable in order to facilitate the felt exchange, the roll exchange and other service operations.

BRIEF DESCRIPTION OF THE DRAWING

The invention is illustrated in the following description with reference to the enclosed drawing, which presents the press section and its frame construction as a schematic lateral view.

DETAILED DESCRIPTION OF THE DRAWING

The frame construction of the press section represented in the drawing comprises the roll combination including rolls 1, 2, 3, 4 and 5. The rolls form three nips N1, N2 and N3. The press section further comprises members for guiding the paper web through the press section and members for guiding one or a plurality of felt 6,7 into contact with the press section. The frame construction comprises the front frame 8, the rear frame 9 and the intermediate frame 10 connecting these two from above the press section. Since the actual structural makeup of the press section does not enter into the scope of the invention, it will not be described in detail here. It is merely noted that in the frame construction according to the invention all prior known press section solutions are applicable with regard to the roll combination and the other machine elements.

The intermediate frame 10 comprises one or a plurality of beams 10 disposed in the longitudinal direction of the paper machine. The intermediate frame can be disposed on both sides of the paper machine. The beams can form one integral assembly or can be disposed separately. At both ends of the intermediate frame 10 members 11*a*, 12*a*, are provided, which cooperate to provide an interlocking with the countermembers 11*b* in the front frame 8, and with the countermembers 12*b* in the rear frame 9. This type of interlocking members can be constructed according to principles that are clear to a person skilled in the art, and consequently their detailed construction will not be described here. With the joints 11 and 12 formed by the members 11*a*, 11*b*; 12*a*, 12*b*, a rigid assembly of the frame construction is achieved in the operating position.

The intermediate frame 10 is removable from the above combination of rolls 1 to 5. The removal is effected horizontally. In the described embodiment this displacement is performed in the longitudinal direction of the paper machine. For this purpose support means 17 are disposed in the removal direction of the intermediate frame, on the level of the rear frame 9 essentially on the same height level as the intermediate frame 10. The intermediate frame 10 is transferred onto the support means 17 when removed from the roll combination. Moreover, on the removal side of the intermediate frame 10, in the rear frame 9, transfer means 18 interact with the intermediate frame 10, by means of which the intermediate frame is transferred from the roll combination into contact with the support means 17 and vice versa.

The construction presented in the applicant's copending patent application Ser. No. 244,881, filed 9-15-88 also appears from the embodiment illustrated in the drawing. The two rolls 3 and 5 included in the press section are both fixed to separate auxiliary frames 13, 14. The auxiliary frames 13, 14 are supported onto the shafts 19 and 20, which are fixed to the front frame 8 (shaft 19) and to the rear frame 9 (shaft 20). The ends of the auxiliary frames 13, 14 opposite with regard to the above points of attachment are fixed to the intermediate frame 10 by the fixing members 15, 16.

We claim:

1. A frame construction in a press section in a paper machine having a longitudinal direction, the press section including a combination of at least two rolls forming at least one press nip, members for guiding the paper web through the press section and members for guiding at least one felt into contact with the press section, said frame construction comprising:

a front frame situated before said roll combination, a rear frame situated after said roll combination and a horizontal intermediate frame interconnecting said front and rear frames above the press section, said intermediate frame comprising at least one substantially horizontal beam extending in the longitudinal direction of the papermaking machine and being located on a level;

means for detachably interconnecting said intermediate frame to said front frame and rear frame whereby said intermediate frame is easily removable from above the roll combination;

transfer means for moving said intermediate frame horizontally and in the longitudinal direction of the papermaking machine in a removal direction between a working position in which said intermediate frame is interconnected above said roll combination to a service position in which said intermediate frame is detached from both front and rear frames by said means for detachably interconnecting same and removed from above said roll combination, thereby providing for an easy access thereto; and a support means provided on the frame construction in the removal direction and located at substantially the same level as said intermediate frame for receiving and supporting said intermediate frame in said service position. intermediate frame.

2. A frame construction of the press section according to claim 1, wherein said support means and said transfer means are both placed on the rear frame.

3. A frame construction of the press section according to claim 1, wherein said intermediate frame consists of one piece.

4. A frame construction according to claim 3, wherein said support means and said transfer means are both provided in said rear frame.

* * * * *